US005996835A

United States Patent [19]

Farrington et al.

[11] Patent Number: 5,996,835

[45] **Date of Patent: *Dec. 7, 1999**

[54] BARREL WITH FLANGED BODY

[75] Inventors: Edward James Farrington, Mijdrecht; Gerrit Jan Van Keimpema, Woerden, both of Netherlands

[73] Assignee: Koninklijke Emballage Industrie Van Leer N.V., Amstelveen, Netherlands

[ * ] Notice: This patent issued on a continued prosecution application filed under 37 CFR 1.53(d), and is subject to the twenty year patent term provisions of 35 U.S.C. 154(a)(2).

[21] Appl. No.: 08/836,206

[22] PCT Filed: Nov. 15, 1995

[86] PCT No.: PCT/NL95/00391

§ 371 Date: May 6, 1997

§ 102(e) Date: May 6, 1997

[87] PCT Pub. No.: WO96/15948

PCT Pub. Date: May 30, 1996

[30] Foreign Application Priority Data

Nov. 17, 1994 [NL] Netherlands ..... 9401926

[51] Int. Cl.[6] ..... B65D 6/32

[52] U.S. Cl. ..... 220/613; 220/617

[58] Field of Search ..... 220/612, 613, 220/616, 617, 618, 619; 294/31.1, 106, 90

[56] References Cited

U.S. PATENT DOCUMENTS

| | | | |
|---|---|---|---|
| 377,495 | 2/1888 | Miller | 220/612 |
| 766,604 | 8/1904 | Dilg | 220/617 |
| 818,438 | 4/1906 | Heindorf | 220/618 |
| 1,125,011 | 1/1915 | Draper | 220/616 |
| 2,587,840 | 3/1952 | Gruetjen | 220/612 |
| 3,073,480 | 1/1963 | Henchert | 220/619 |
| 3,292,811 | 12/1966 | Lynch . | |
| 3,306,488 | 2/1967 | Lemelson . | |
| 3,315,839 | 4/1967 | Catalano et al. | 220/617 |
| 3,660,188 | 5/1972 | Van Leer . | |
| 4,213,647 | 7/1980 | Thurmond, Jr. . | |
| 4,941,584 | 7/1990 | Bowers et al. | 220/613 |

FOREIGN PATENT DOCUMENTS

| | | |
|---|---|---|
| 0 412 272 | 2/1991 | European Pat. Off. . |
| 2 258 312 | 8/1975 | France . |
| 2 314 104 | 1/1977 | France . |
| 26 53 562 | 6/1978 | Germany . |
| 34 28 191 | 2/1986 | Germany . |
| 9 301 856 | 5/1995 | Netherlands . |

*Primary Examiner*—Stephen Castellano
*Attorney, Agent, or Firm*—Young & Thompson

[57] ABSTRACT

A barrel comprises a tubular body (1) and two end faces at opposite ends of the body, which body and end faces are made of a plastic material and are fixed to each other by welding or gluing. In order to obtain a strong fixing which can withstand lifting forces, at at least one of its ends (3) the body is a gradually widening or narrowing shape, and the respective end face (2) has a correspondingly shaped edge which is fixed to the gradually widening or narrowing end of the body.

6 Claims, 2 Drawing Sheets

BARREL WITH FLANGED BODY

FIELD OF THE INVENTION

The invention relates to a barrel with a tubular body and two end faces at the opposite ends of said body, which body and end faces are made of a plastic material and are fixed to each other by welding or gluing.

BACKGROUND OF THE INVENTION

Such a barrel is described in Application NL-A-9301856 (not a prior publication). The body of this known barrel has a radially outward pointing body flange, on which a corresponding ridge of an end face is welded. When this barrel is being lifted up with a lifting device, the major part of the lifting forces is exerted on the body flange. During this, the welded joint between said flange and the ridge of the end face is hardly affected at all by said lifting forces.

The join between the body and the end face of said barrel is in the form of a butt joint. Such a welded joint is not so suitable for the transmission of tensile forces. Since, as explained above, this welded joint is not placed under any load by lifting forces, the risk of giving way as the result of said lifting forces is low.

Such a butt joint has the disadvantage that during manufacture it must be ensured that the ridge and the flange are positioned correctly relative to each other. Besides, the butt joint is still vulnerable as regards other loads, such as shock loads arising from dropping the barrel, internal excess pressures and so forth.

SUMMARY OF THE INVENTION

The object of the invention is therefore to provide a barrel which does not have these disadvantages. This is achieved through the fact that at at least one of its ends the body is a gradually widening or narrowing shape, and the respective end face has a correspondingly shaped edge which is fixed to the gradually widening or narrowing end of the body.

The advantages of the join between the body and the end face of the barrel according to the invention are twofold. First of all, such a fixing is an overlapping join, which has the advantage that the loads are transmitted by means of shearing forces, and not by tensile forces such as above. The fixing between the body and the end face according to the invention is therefore equipped for transmitting the lifting forces, which means that no special body flange is necessary in this respect, as is the case in the known barrel.

Moreover, the end face can be a constant thickness, in other words the peripheral edge thereof can be the same thickness as the central part thereof. This means that it is also possible to manufacture the end face by means of vacuum forming. Besides, such a design leads to less distortion and fewer irregularities.

Despite the constant thickness of the end face, a thickness which is necessary for correctly lifting up the barrel is still obtained at the edge of the barrel, due to the combined thicknesses of end face and body in their regions which are welded to each other.

In addition, the manufacturing process is considerably simpler, given the fact that the gradually widening or narrowing shapes of the body and the end face make them self-centering with respect to each other. It is also sufficient to press these parts towards each other in the axial direction. Moreover, when they are moving towards each other the gradually widening or narrowing body and end face do not touch each other until they are practically in the correct position relative to each other. This means that hardly any shearing movements occur on the interacting surfaces of the body and the end face, which leads to a better join.

The welded joint has a relatively large surface area, which makes it less critical. Even a poorer welded joint would function adequately, in view of that large area and the low stresses arising therefrom.

According to a first preferred embodiment, the end widens out in the direction of the outside of the body, and the outer periphery of the edge of the end face is connected to the inner periphery of the gradually widening end of the body.

In order to provide a suitable lifting means, the edge of the end face bears a peripheral apron which surrounds the edge at the outside. The apron can also be a gradually widening or narrowing shape, in such a way that it projects slightly relative to the body. The apron can be gripped at its underside. It provides a certain flexibility, resulting in a damping effect as regards shock loads arising from the lifting forces.

The edge and the apron also define a peripheral hollow for the accommodation of the gradually widening or narrowing end of the body. The top outer limit of the body and the fixing are concealed in said hollow, which leads to a better outer appearance.

The apron can have a radial outer flange, which offers a further improved grip for a lifting device (see FIG. 2).

According to a second possibility, the end is designed in such a way that it narrows in the direction towards the outside of the body, and the inner periphery of the edge of the end face is connected to the outer periphery of the narrowing end of the body.

The end face part adjoining the edge can also have a recessed region. Such a design makes it possible to grip the barrel better.

Here again, the recessed region and the edge define a peripheral hollow for the accommodation of the end of the body.

It is pointed out that the invention relates both to a barrel which has an end face of the type described above at both ends and to a barrel which has such an end face at only one end. In the latter case the other end can have, for example, an integral base.

The tubular body can have a polygonal or a cylindrical cross-section.

BRIEF DESCRIPTION OF THE DRAWING

The invention will be explained in greater detail with reference to various embodiments shown in the figures.

DESCRIPTION OF THE PREFERRED EMBODIMENTS

Figure 1:
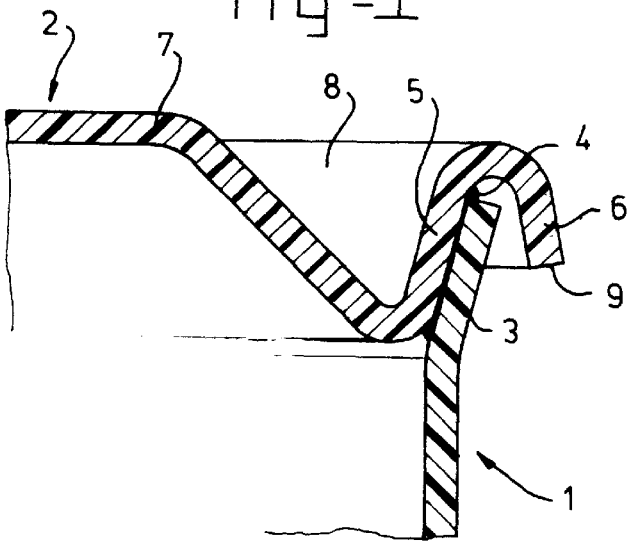
FIG. 1 shows a part of the top edge of a barrel, in a radial cross-section.

The barrel shown in FIG. 1 has a tubular body 1, preferably a cylindrical body, and an end face 2. The body 1 has a conically shaped end 3, which is fixed to end face 2 by means of welded joint 4.

The end face has a correspondingly shaped edge 5, and also an apron 6. The outside of the edge 5 is fixed by means of welded joint 4 to the inside of the conically shaped end 3 of body 1. The end face also has a central part 7. which together with edge 5 forms a peripheral recess 8. The barrel can be gripped by means of a gripping device at the underside 9 of the apron 6 and also in the recess 8. The apron 6 has a certain flexibility, which damps any shock loads exerted by the gripping device.

The lifting forces are borne by apron 6 and edge 5, and are transmitted to the body 1 by way of welded joint 4 and conically shaped part 3. With such a transmission of lifting forces, the welded joint 4 is almost entirely loaded by shearing forces, which the welded joint 4 can easily withstand.

The join between end face 2 and body 1 of the barrel has the further advantage that during manufacture these parts need only be moved towards each other in an axial manner. Only in the very last part of this movement do the facing surfaces of edge 5 and the conically shaped end 3 come into contact, which leads to virtually no shearing movements in the material of the welded surfaces. A very reliable welded joint is obtained in this way.

Figure 2:
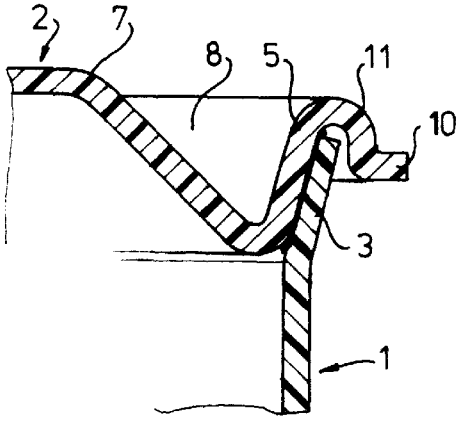
FIG. 2 shows a cross-section of a second embodiment.

In the embodiment of FIG. 2 the apron 11 has a radial flange 10, which offers better gripping possibilities for the lifting device.

Figure 3:
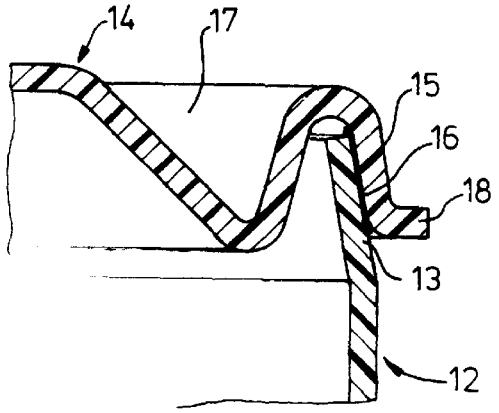
FIG. 3 shows a cross-section of a third embodiment.

In the embodiment of FIG. 3 the body 12 has a conically shaped end 13 which points inwards.

The end face 14 has a correspondingly shaped edge 15, the internal surface of which is welded to the external surface of the conically shaped end 13 by means of welded joint 16. The end face 14 also has a recess 17, and the edge 15 is also provided with a radial outer flange 18.

The radial flange 18 and the recess 17 can be gripped by a gripping device. The same advantage of a favourable load on the welded joint 16, i.e. essentially shearing forces, is also obtained here.

Figure 4:
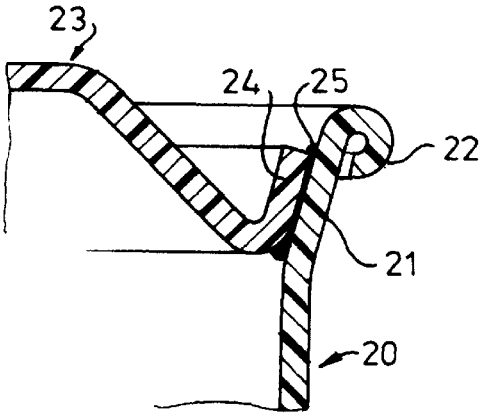
FIG. 4 shows a cross-section of a fourth embodiment.

The embodiment of FIG. 4 shows a barrel with a tubular body 20, provided with a conically shaped end 21 bearing a body bead 22. The end face 23 has a correspondingly shaped edge 24, welded to end 21 by means of welded joint 25. The shaping or flanging of the conically shaped end 21 and the provision of beading in the body (body bead 22) can be carried out in one and the same operation.

In all the above-mentioned embodiments the manufacture is simplified by the self-centering nature of body and end face, in particular the conically shaped edges 5, 15 and 24 respectively thereof.

Although the figures and corresponding description above relate to a cylindrical body, the invention is not restricted to such an embodiment. The body could also be, for example, an oval or square shape.

Figure 5:
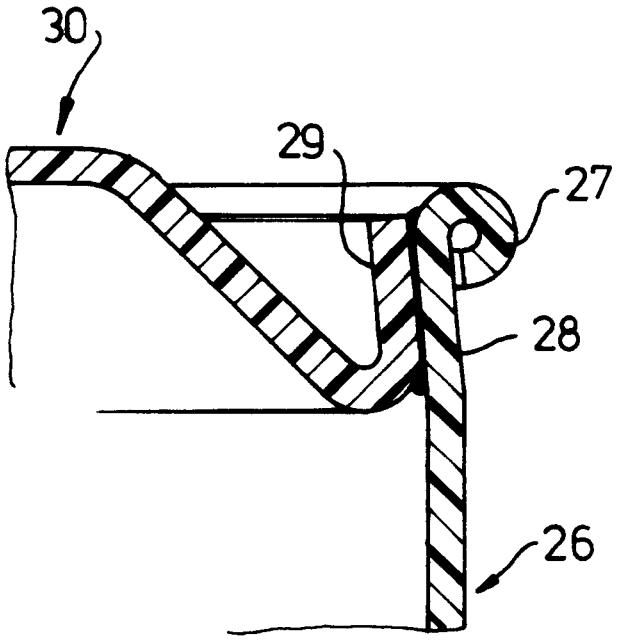
FIG. 5 shows a cross-section of a fifth embodiment.

In FIG. 5 the body 26 has a conically shaped body end 28 which points inwards slightly. The end face 30 has a correspondingly shaped edge 29, the outer periphery of which is welded to the inner periphery of end 28.

Figure 6:
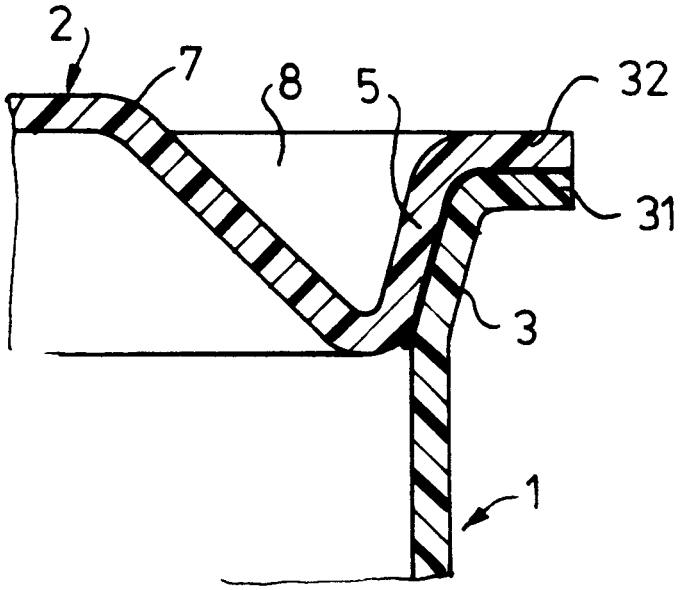
FIG. 6 shows a cross-section of a sixth embodiment.

The embodiment of FIG. 6 corresponds largely to that of FIG. 1. However, in this case both the end face 2 and the body end 3 have a radial flange 32, 31 respectively, which are welded to each other.

Although in the embodiments shown in the figures the end face 2 projects a little relative to the tubular body 1, it is, of course, also possible for said end face to be placed at a lower level.

We claim:

1. A barrel comprising a tubular body and two substantially planar end faces at opposite ends of the body, said body and end faces being made of a plastic material and being fixed to each other by one of welding and gluing, so as to provide a means for receiving a gripping tool, wherein at at least one of its ends the body is a gradually widening shape, and a respective end face has a correspondingly shaped edge which is fixed to the gradually widening end of the body, the end face comprising a central planar region, a circumferentially extending peripheral annular recessed region, and a peripheral apron provided with a terminal part, said central planar region being radially inward of both the recessed region and the apron, said circumferentially extending peripheral annular recessed region being disposed between said central planar region and said apron, and said terminal part and recessed region together constituting the means for receiving the gripping tool.

2. The barrel according to claim 1, wherein the correspondingly shaped edge has an outer periphery which is fixed to an inner periphery of the gradually widening end.

3. The barrel according to claim 2, wherein the apron is radially outward of the gradually widening end and surrounds the gradually widening end.

4. The barrel according to claim 3, wherein the correspondingly shaped edge and the apron define a peripheral hollow for accommodating the gradually widening end.

5. The barrel according to claim 3, wherein the apron has a radial outer flange.

6. The barrel according to claim 1, wherein the body is cylindrical and has a conically shaped end.

* * * * *